United States Patent [19]

Appelgren

[11] Patent Number: 4,756,181

[45] Date of Patent: Jul. 12, 1988

[54] METHOD OF MAKING A CHAIN BINDER LOCKING AND UNLOCKING TOOL AND PRODUCT

[76] Inventor: Dallas A. Appelgren, P.O. Box 88, Hillman, Mich. 49746

[21] Appl. No.: 25,153

[22] Filed: Mar. 12, 1987

[51] Int. Cl.[4] ..... B21K 21/12

[52] U.S. Cl. ..... 72/367; 74/544; 81/177.2; 254/120

[58] Field of Search ..... 72/367; 74/523, 543, 74/544; 81/177.1, 177.2, 489; 254/120, DIG. 3; 16/114; 294/57, 58

[56] References Cited

U.S. PATENT DOCUMENTS 1,744,413 1/1930 Peterson et al. ..... 81/177.1
2,629,584 2/1953 Cannon ..... 254/120
4,049,082 9/1977 Reid ..... 72/367
4,691,599 9/1987 Schultz ..... 81/489

*Primary Examiner*—Lowell A. Larson
*Attorney, Agent, or Firm*—Learman & McCulloch

[57] ABSTRACT

A method of making and using a tool for use in locking and unlocking a load-enveloping chain binder, the tool being formed by cutting off the front end of a cylindrical pipe section at an acute angle to provide a leading edge on one side of the front end and an opposite trailing edge. One side of the pipe section is creased rearwardly of both the leading and trailing edges to form an axially sloping, internal, piloting and stop projection against which the handle of the chain binder is received, and while simultaneously squeezing the lateral sides of the pipe pipe section to provide a handle rearwardly of the internal projection.

4 Claims, 1 Drawing Sheet

METHOD OF MAKING A CHAIN BINDER LOCKING AND UNLOCKING TOOL AND PRODUCT

BACKGROUND OF THE INVENTION

Chain binders, of the type wherein a handle goes from a locked over center position in which the binder is tensioned to an unlocked position in which the tension is abruptly released as the handle moves back through center position to unlocked position, are in wide use in industry for enveloping loads such as elongate steel tubes, for instance, and securing the loads on the truck beds. The locking and unlocking of the chain binder requires substantial force, and, when the handle of the chain binder is released, tends to impart a sudden and rapid movement to the handle which is dangerous to the operator, when a leverage increasing extension is temporarily applied to the tightener handle. Such leverage increasing extensions, which typically are simply lengths of pipe can snap upwardly to injure the face of the party performing the unlocking operation, or if the extension is torn from his grasp, the extension may be cast a substantial distance from the load to endanger other workers and equipment.

A number of handle extensions have been proposed in the past, as indicated in the following listed patents,

| | | | |
|---|---|---|---|
| 2,986,054 | Lurie | 3,843,981 | Verest |
| 3,119,278 | Simpson | 3,864,769 | Hamilton |
| 3,657,944 | Able | 4,297,916 | Burroughs |

but to my knowledge none could be manufactured at a marketable cost, with the result that the old and dangerous pipe sections continue in use by many truck operators.

SUMMARY OF THE INVENTION

The present invention seeks to promote safety in those industries which employ chain binders and to avoid the accidents which, not infrequently, occur.

The tool can be readily fashioned by cutting off the front end of the pipe section an acute angle and deforming the side of the pipe section leading axially from the leading edge of the tool at a spaced distance rearwardly thereof to provide an internal projection system to coact with the chain binder handle.

One of the prime objects of the invention is to provide a method of making a tool which can be used to facilitate both the locking and unlocking of chain binders in a very inexpensive manner, such that it can be sold at a price individual truck owners, for example, can well afford.

Another object of the invention is to provide a tool which maintains its position during both locking and unlocking operations, while permitting and facilitating binder handle-releasing, relative movement when the handle returns past center position.

Still another object of the invention is to provide a method of making a tool wherein creasing of the one side of the tool in an axial direction dually provides both a binder handle-piloting internal projection and a handle of reduced cross section for easy grasping.

Still another object of the invention is to provide an extension tool which is easy and convenient to use, and which readily disengages from the chain binder handle so that it can be returned to storage position on the truck, for use when desired.

Still another object of the invention is to provide a tool which has a built-in piloting and stop projection and avoids the need for the removal and insertion of a stop pin each time the tool is used.

Other objects and advantages of the invention will be pointed out specifically, or will become apparent from the following description, when it is considered in conjunction with the appended claims and the accompanying drawings.

IN THE DRAWINGS

Figures 1, 2, 3, 4, 5, 6, 7, 8:
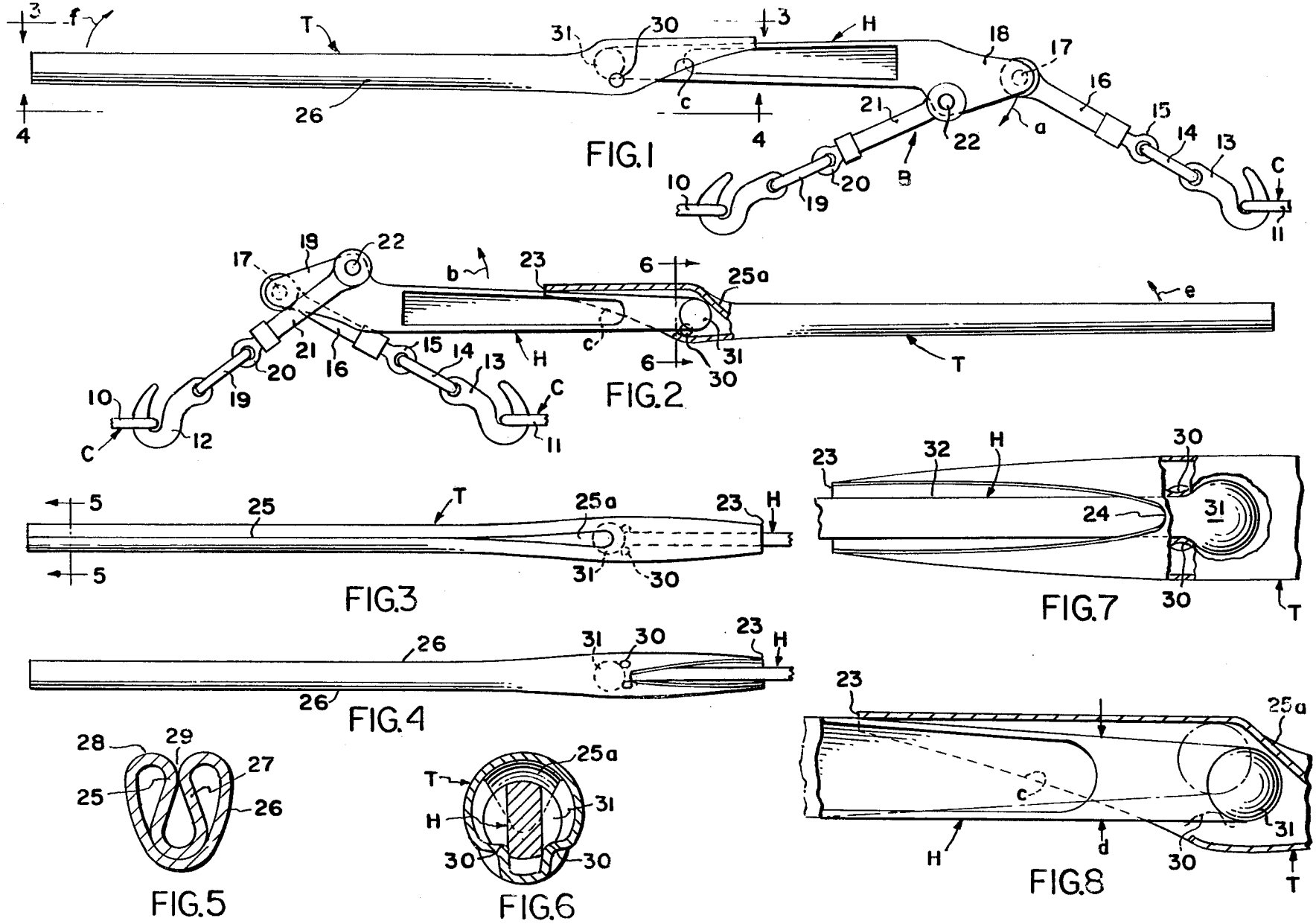
FIG. 1 is a side elevational view showing the extension tool receiving the handle of a load enveloping chain binder for the purpose of tightening and locking the free ends of the load enveloping chain.
FIG. 2 is a similar side elevational view, partly in section, illustrating the position of the tool when it has been swung through an arc of approximately 180° and moves the handle to a locked, over-center position in which the load is tightly compressed by the load binder chain.
FIG. 3 is a plan view taken on the line 3—3 of FIG. 1.
FIG. 4 is an under plan view taken on the line 4—4 of FIG. 1.
FIG. 5 is an enlarged cross-sectional view through the handle of the tool taken on the line 5—5 of FIG. 3.
FIG. 6 is a transverse, cross-sectional view taken on the line 6—6 of FIG. 2.
FIG. 7 is an enlarged, fragmentary, partly sectional plan view illustrating the manner in which the ball projections on the chain binder handle restrain relative axial movement of the extension member and handle.
FIG. 8 is a side elevational, partly sectional view thereof.

Referring now more particularly to the accompanying drawings, the handle extension tool generally designated T is shown in FIG. 1 as receiving the handle piece generally designated H of a chain binder B which includes a chain C which, it is to be understood, is enveloping a load on a truck or the like. The opposite end links 10 and 11 of chain C are received on a pair of hook members 12 and 13, respectively. The hook 13 is connected by a link 14 to the eye 15 of a rod 16 which is pivoted as by a pivot pin 17 to one end of a portion 18 of handle H. The hook 12 is connected by a link 19 to an eye 20 provided on a rod 21 which pivots to the portion 18 of the handle H, as with a pivot pin 22.

In FIG. 1, the pins 17 and 22 are shown in a position in which hooks 12 and 13 are relatively relaxed. It is when the handle H is swung 180° from the FIG. 1 position to the FIG. 2 position that pin 17 moves in the arc a to a position on the opposite side of pin 22 and the hooks 12 and 13 are brought relatively together to tighten the chain C. Unlocking of the chain binder is accomplished by moving the pin 17 in a reverse direction along the path a, and it is when pin 17 passes pin 22 that an abrupt releasing force tends to snap the handle H in a counterclockwise direction in arc b (FIG. 2). While, for purposes of convenience, the chain binder is shown in horizontal disposition in FIGS. 1 and 2, it should be understood that normally it will be disposed in vertically inclined position on the side of a load so that it is more accessible, rather than on the top of the load.

The present tool is economically fashioned from a pipe section of, for example, two inches in diameter. The steel pipe section is cut off at an acute angle c to provide a leading edge 23 and an opposite side trailing edge 24. Adjacent to, but rearwardly of, the trailing edge 24, the wall of the tube T is creased as at 25 to provide an axially inclined pilot and stop wall 25*a*. At the same time, a squeezing pressure is applied to the lateral sides 26 of the tube with the result that the wall tube axially opposite the leading edge 23 rearwardly beyond the transition section 25 assumes the inverse loop shape 27 disclosed in FIG. 5. The curvilinearity of the portions 28, which prior to the forming operation were portions of the lateral side wall portions 26, leaves a groove 29 and the simultaneous creasing and squeezing operation provides a configuration of reduced cross section, which can be more readily grasped by the hand of the user. The portion of the extension tool which extends rearwardly from the creasing-transition wall 25 thus is of the reduced, cross-sectional configuration disclosed in FIG. 5.

Depressed axially rearwardly adjacent of the trailing edge 24, are a pair of spaced apart, internal side dimples 30, which are carefully positioned with respect to the wall surface 25. The dimples 30 are formed by pressing in the metal of the wall portion of the tube opposite the trailing edge 24 just laterally beyond it. It is to be observed that the handle H, at its outer free end, is provided with semi-spherical projections 31 on its side walls, which protrude laterally beyond the side walls 32 of the handle. As FIGS. 6 and 7 particularly indicate, these wall portions 31 insert behind the internal dimple projections 30 to restrict linear axial separation of the tool T and handle H. The tube T is of sufficient diameter, and the wall 25*a* is so positioned with respect to the dimples 30, that the handle, which is initially received in the chain line position shown in FIG. 8, is piloted up to the solid line position by the wall 25*a*. There must, accordingly, be sufficient play in the tube T to permit this, and the tube T must be of a diameter with respect to the dimension d of the handle H to permit this movement from the chain line position shown in FIG. 8 to the solid line position.

THE OPERATION

Directing attention now particularly to FIG. 2, to facilitate the description of an unlocking operation, the tool T is shown received on the handle in a position to be moved upwardly in the arc e to unlock the chain binder. In this relative position of the handle part 31 behind the dimples 30, which was effected via the piloting surface 25, the tool T is restricted from being withdrawn linearly axially from the handle H. As the handle H moves upwardly in the arc e and pivots the handle H upwardly, the pivot 17 swings in a counterclockwise direction around the pivot 22 and when the pivots 17 swing past vertical alignment in FIG. 2 with the pivot 22, there is an abrupt release of the tension in chain ends C, which causes the handle H to snap partly upwardly in the direction b. This movement causes composite axial and radial movement of the handle H, and the ball portions 31 thereof, upwardly along the wall 25 to withdraw the portions 31 from behind the dimple projections 30 and permit the relative axial separating movement of the handle H from the tool T which dissipates the force which otherwise would be applied to the tool T, and which would tend to rip it from the grasp of the operator.

Of course, the tool T is also useful in locking up the chain binder in the first place. When this is to be done, the tool is applied to the handle in the position indicated in FIG. 1. The tool T is moved in the arc f, and safely accommodates the handle H in the same engaged position with ball parts 31 engaged behind the dimples 30.

While one embodiment of the invention has been described in detail, it will be apparent to those skilled in the art that the disclosed embodiment may be modified. Therefore, the foregoing description in all aspects is to be considered exemplary rather than limiting in any way, and the true scope of the invention is that defined in the following claims.

What is claimed is:

1. A method of making a tool for use in locking and unlocking a load-enveloping chain binder having a handle, with opposed lateral projections on its free end, which is moved from a locked over-center position in which the binder is tensioned to an unlocked position in which the tension is abruptly released as the handle moves back through center position to unlocked position comprising:

a. cutting off the front end of an elongate cylindrical linear pipe section, having an internal diameter larger than the cross-sectional dimensions of the handle such that the handle is shiftably accommodatable therein, at a relatively acute angle to provide a leading edge on one side of the front end and an opposite trailing edge on the opposite side of the front end, both of said sides being bounded by lateral walls; and b. severely creasing the said one side of the pipe section from a location spaced rearwardly of both said leading and trailing edges to its rear end to form an axially sloping, internal, piloting and stop projection against which the handle end is received, and while simultaneously exerting squeezing pressure on the said lateral sides of the pipe section from said location to the rear end of the pipe section to deform the pipe section, rearwardly of said internal projection, to a reduced-in-cross-section, easy-to-grasp handle.

2. The method defined in claim 1 comprising depressing laterally spaced apart, internal dimple projections in said opposite side of the pipe section rearwardly of the said trailing edge, and adjacent said internal projection, for engaging the said projections on the handle.

3. The method defined in claim 2 in which said dimple projections are in front of said axially sloping projection so that said projections tend to prevent linear axial withdrawal of said handle by resisting axial movement of said handle projections while permitting a withdrawal of said handle in first a radial path so that said handle projections clear said internal dimple projections.

4. A method of making a took for use in locking and unlocking a load-enveloping chain binder having a handle, with opposed ball side projections on its free end, which is pivotal from a tensioned, locked over-center position to an unlocked position in which the tension is abruptly released as the handle moves back through center position to unlocked position comprising:

a. cutting off the front end of an elongate cylindrical pipe section, having an internal diameter slightly larger than the cross-section of the handle such that the handle is radially shiftably accommodatable therein, at a relatively acute angle to provide a leading edge on one side of the front end and an opposite trailing edge on the opposite side of the front end rearward of the said leading edge, the edges both being bounded by lateral side walls;

b. providing said one side of the pipe section at a location spaced inwardly of both said leading and trailing edges with an internal shoulder projection against which said handle seats and bears when it is received in said front end of the pipe section; and c. depressing laterally spaced apart internal projections on said opposite side of the pipe rearwardly adjacent the said trailing edge for engaging behind the ball projections on the handle.

* * * * *